US005689903A

United States Patent [19]

Aumann

[11] Patent Number: 5,689,903

[45] Date of Patent: Nov. 25, 1997

[54] PROTECTIVE WATERPROOF SHOE

[76] Inventor: Johann Aumann, Bergham 2, D-83052 Bruckmuhl, Germany

[21] Appl. No.: 544,517

[22] Filed: Oct. 18, 1995

[30] Foreign Application Priority Data

Dec. 2, 1994 [DE] Germany ..... 44 43 002.7

[51] Int. Cl.[6] ..... A43C 13/14; A43B 13/28; A43B 23/26

[52] U.S. Cl. ..... 36/77 R; 36/12; 36/55

[58] Field of Search ..... 36/10, 12, 55, 36/43, 44, 83, 77 R

[56] References Cited

U.S. PATENT DOCUMENTS

| | | | |
|---|---|---|---|
| 3,953,566 | 4/1976 | Gore | 264/288 |
| 4,187,390 | 2/1980 | Gore | 174/102 R |
| 4,194,041 | 3/1980 | Gore et al. | 428/315 |
| 4,353,173 | 10/1982 | Paquet | 36/77 R X |
| 4,493,870 | 1/1985 | Vrouenraets et al. | 428/245 |
| 4,574,497 | 3/1986 | Jindra | 36/77 R |
| 4,725,481 | 2/1988 | Ostapchenko | 428/213 |
| 4,899,465 | 2/1990 | Bleimhofer et al. | 36/12 X |
| 5,285,546 | 2/1994 | Haimerl | 36/12 X |

FOREIGN PATENT DOCUMENTS

| | | | |
|---|---|---|---|
| 0080710 | 6/1983 | European Pat. Off. . | |
| 0298360 | 1/1989 | European Pat. Off. . | |
| 4000156 | 7/1991 | Germany | 36/55 |
| 9200099.1 | 4/1992 | Germany . | |
| 9404207.1 | 5/1994 | Germany . | |
| 4311768 | 10/1994 | Germany . | |

*Primary Examiner*—B. Dayoan
*Attorney, Agent, or Firm*—Gary A. Samuels

[57] ABSTRACT

Footwear includes a shaft and a laminate which lines the shaft. The laminate has a waterproof, water vapor permeable functional layer, a rigid protective cap is between the shaft and the laminate. In the toe area, the laminate is designed as a bootie. An insole which serves as a mechanical protection between the laminate and the protective cap is located between the outsole side of the bootie and an outsole side edge of the protective cap.

4 Claims, 2 Drawing Sheets

PROTECTIVE WATERPROOF SHOE

FIELD OF THE INVENTION

The invention relates to footwear. More specifically, it relates to waterproof, water vapor permeable footwear.

BACKGROUND OF THE INVENTION

In the course of the last years, waterproof, yet water vapor permeable membrane material has been increasingly used to produce waterproof clothing. Being permeable to vapor, such materials are very comfortable to wear. An example for such a membrane material is expanded polytetrafluoroethylene (PTFE) consisting of polyester or a microporous polyurethane coating.

Recently such membrane materials have also been used to make waterproof footwear. In this application the inside of at least the shoe shaft is clad with such a membrane material, which is referred to as "functional layer" herein. An example is shown in European printed publication EP-A2-0080710. The cladding is mostly formed by a lining in the form of a laminate which comprises the functional layer and a textile layer on its side facing the inside of the shoe.

In such constructions the seams, which are produced when the shoe shaft is sewn to the lining and the insole, become a problem because at the stitched parts the functional layer becomes perforated and permeable to water.

To overcome this problem, an injection-molding process can be used In which the underside of the footwear or the insole and the underside of the shaft with the functional layer, which may be sewn to the insole, is surrounded by a caoutchuc or plastic sole forming the outsole. The connection seam between the shaft and the lining and the insole is enclosed by the caoutchuc or rubber outsole. The shaft usually consists of leather or a textile fabric, e.g. made from synthetic fibers.

The injection-molded plastic sole seals the seam between the functional layer and the shaft and insole against direct contact with water, but the mentioned shaft materials, in particular leather shafts, typically conduct water in their longitudinal direction. This process involves capillary effects. If the shaft area which is not covered by the plastic sole becomes wet, this longitudinal conduction effect will make water creep along the shaft up to the seam located on the inside of the injection-molded plastic sole where it can penetrate the functional layer through the holes produced by sewing.

The functional layer is usually located on the inside of a laminate which is coated with a protective textile on the side facing the shaft and with a lining material on the side facing inwards. Since shoes are normally produced in mass production, the formation of water bridges on the lower ends of shaft and lining can hardly be prevented, at least not in a cost-efficient way. These water bridges may be formed by threads which project from the cut lining piece and reach over the cut end of the functional layer to the shaft material. It is in particular when the shaft material consists of a textile fabric that the shaft end and the lining end may not be cut on the same level so that threads or parts of the textile shaft material bridge the cut end of the functional layer and form a moisture bridge reaching up to the lining of the shoe.

The lining material which clads the inside of the shoe is usually absorbent and water conducting. Water entering the shoe along the shaft and penetrating through the seam and/or the water bridges mentioned above will creep along the lining into the shoe.

To overcome this problem, printed publication EP-B1-0298360 describes the use of waterproof footwear comprising a shaft, a shaft lining with a waterproof and water vapor permeable microporous functional layer, an insole the circumference of which is sewn to the lower end area of the lining and an outsole consisting of a waterproof plastic material injection-molded to the lower shaft area. The lower shaft area located in the outsole area is sewn to a porous material which can be penetrated by the plastic outsole material, which is liquid during the injection-molding process. In this state of the art footwear the shaft material is cut such in the sole area that it ends at some distance from the lower lining end. The end of the shaft material itself is connected to the insole and the lower lining end through a connection material formed by the porous material; the porous connection material is sewn to the shaft material itself on one end, but not to the lining and to the insole by a seam on the other end. This state of the art footwear can be produced by a state of the art process, which is also known from printed publication EP-B1-0298360. The lining is provided with a waterproof and water vapor permeable microporous functional lining, then the lower end of the shaft material itself is cut such that it has a certain height distance from the lower end of the lining and is extended using the porous material as a connection material. Then the lining and the end of the porous connection material facing away from the shaft material itself are sewn together and sewn to the circumference of an insole at their lower ends through a seam. Finally the plastic outsole is mounted by injection molding.

As shown in FIG. 1 a shoe of the type described in EP-B1-0298360 has a shaft S which consists, e.g., of leather or a textile fabric, preferably plastic. The inside of the shaft S is lined with a laminate L which serves as an inner lining and comprises a waterproof, water-vapor permeable functional layer or membrane M which is lined with a textile fabric T on the side facing the shaft S and with a lining material F on the side facing the inside of the shoe. The lining material and the textile fabric T form a mechanical protection for the functional layer M. The composite assembly comprising the shaft S and the laminate L is sewn to the edge of an insole B on its lower end, the corresponding seam is designated as N. A sole K consisting of a suitable waterproof plastic material is injection molded to the underside of the insole B and the lower area of the shaft S sewn thereto. The upper edge O of the sole K lies so high that the seam N is enclosed by the sole K. The seam N is thus sealed against direct contact with water.

However, water which comes into contact with the part of the shaft S which lies outside of the sole K may creep along the shaft on the inside of the sole K up to the seam where it can go through seam stitch holes in the functional layer M and reach the interior of the shoe.

In state of the art footwear as shown in FIG. 2, the shaft S does not reach up to the insole B, but the lower shaft end has a distance to the insole edge. This distance is bridged by a perforated or porous connection material V. The outer edge of the connection material V is sewn to the inner edge of the shaft S by a first seam N1. The laminate L, however, is not sewn to the shaft S at this spot. The other end of the connection material V is sewn to the insole B together with the inner end of the laminate L by a second seam N2.

The porous connection material V is preferably realized by a net band consisting of monofilic synthetic fibers. It is particularly favorable to select a mesh width of min. 1.5 mm. Suitable synthetic fibers are polyamide or polyester.

When the sole K is injection molded to the shoe, liquid sole material penetrates the pores or holes or loops of the connection material V until it reaches the outside of the laminate L so that the seam stitch holes of the second seam N2 are sealed with the sole plastic.

Since the lower shaft area is formed by a connection material V with holes or pores which is connected to the shaft itself, water conducted by the shaft itself cannot reach the seam connecting shaft, lining and insole so that even water bridges formed by the seam and by threads or fabric pieces forming bridges across the functional layer cannot have any effect because the water conducted by the shaft cannot reach them.

Even if footwear of this type and the process described for its production has proven very useful for various types of casual shoes, new problems arise when footwear needs to be reinforced by incorporating a rigid protective cap, e.g. of steel or thermoplastic material.

In a protective shoe with a protective cap this state of the art principle cannot be applied in the toe area because the shell material is under high tension after insertion of the protective cap and a Strobel sewing machine, which is used for sewing, cannot grasp the material such that the connection material can be sewn to the lining or insole.

Instead, in protective shoes the lining is usually stroble-sewn to the insole at the front shoe shaft part, then the protective cap is inserted between the lining and the face material and then the face material is manually glued to the insole.

SUMMARY OF THE INVENTION

The object of the invention is to provide for footwear with a protective cap which is arranged in the toe area between the footwear shaft and a laminate lining the shaft whose underside facing the outsole goes under the insole over a predetermined width. A bootie consisting of a laminate is arranged in the toe area on the side of the insole facing the foot. A shaft material is connected to the insole circumference in the toe area on the side of the insole facing the outsole by a glued connection.

BRIEF DESCRIPTION OF THE DRAWINGS

In the following, the invention will be explained in more detail with reference to an embodiment and FIGS. 1–4.

DETAILED DESCRIPTION OF THE INVENTION

Figure 1:
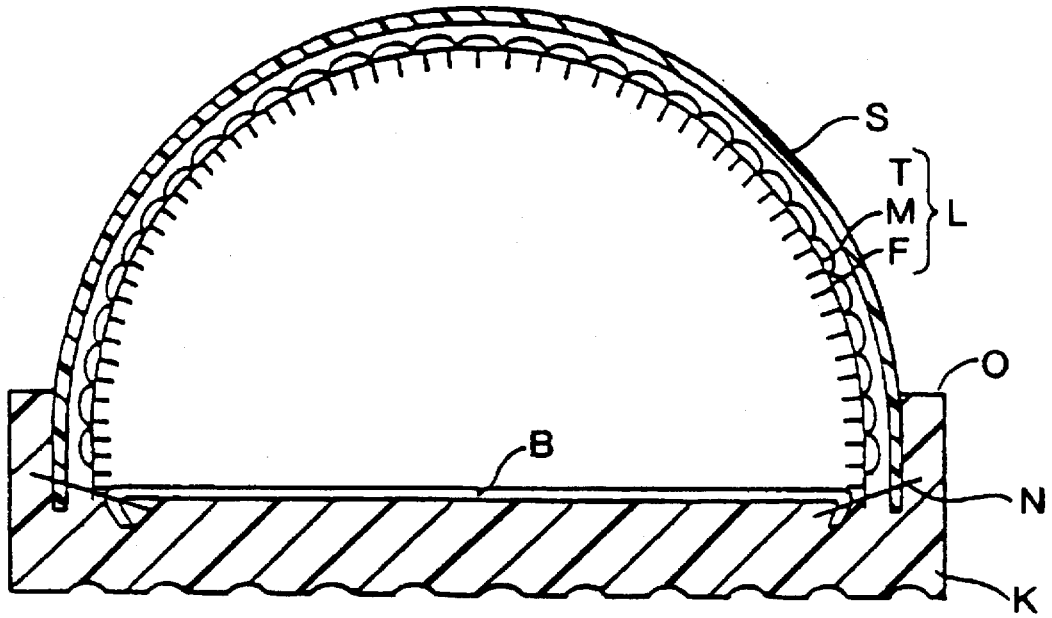
FIG. 1 is a cross-sectional drawing of the middle foot area of state of the art footwear.
Figure 2:
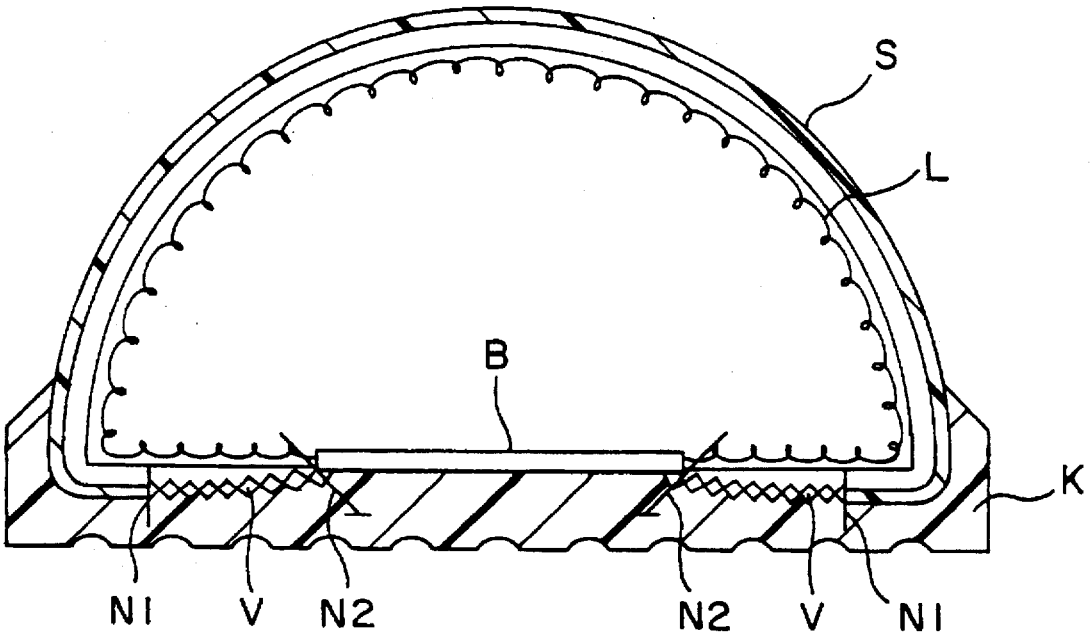
FIG. 2 is a cross-sectional drawing of the middle foot area of state of the art footwear.
Figure 3:
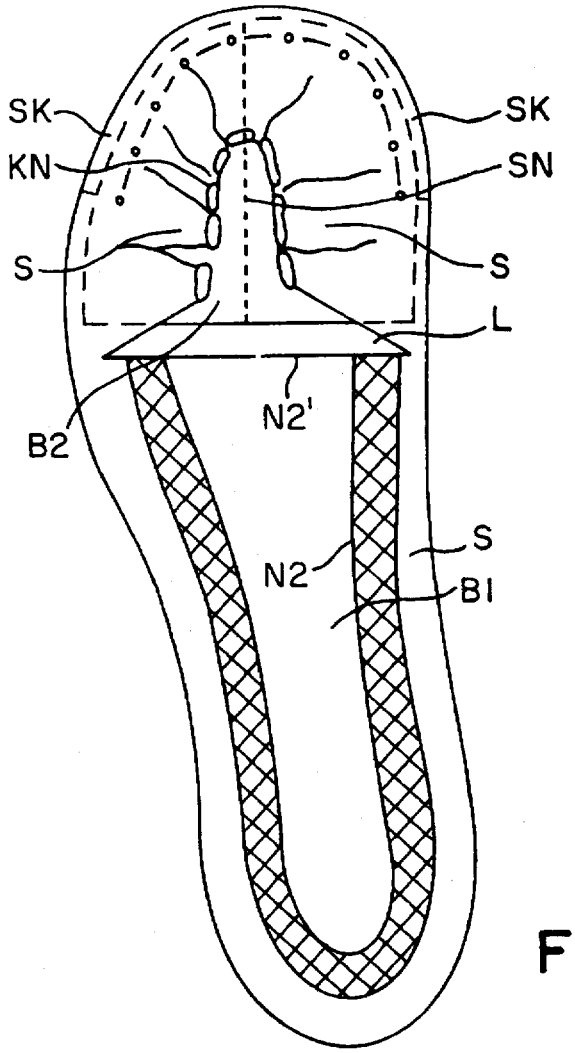
FIG. 3 is a top view of the underside of the insole of footwear designed according to the invention.

FIG. 3 is a view from below of the underside of footwear to which the outsole is not yet mounted and which has the same design in the middle foot and heel area as the footwear shown in FIG. 2.

In the footwear shown in FIG. 3 the insole has two separate insole pieces, namely a rear insole part B1 in the area of the middle foot or the heel and a front insole area B2 in the toe area. In the toe area the insole part B2 is visible within the shaft material S which reaches down to the shoe underside. In the toe area the footwear has a rigid protective cap SK consisting of a highly pressure and impact resistant material, in the area between the shaft S and the laminate L. The area facing the outsole goes under the insole part B2 on its outside. The laminate L facing the interior of the shoe consists of two laminate flap pieces which are put together by a seam SN on the inside of the insole piece B2 to form a partial sock (bootie) in the toe area. In the toe area the shaft material S is guided over the protective cap SK and connected to the outside of the insole part B2 by a glued lasting connection KN.

The front insole piece B2 is located between the laminate L and the area of the protective cap SK to protect the laminate L against mechanical damage by the protective cap SK which goes over the insole piece B2. The insole piece B2 is glued onto the laminate outside. The part of the bootie facing the middle foot area is connected to the insole piece B1 by a seam N2, which may be a sewn seam.

The two insole pieces B1 and B2 may consist of different materials. The insole piece B1 may consist of a fleece material. The insole material B2 may consist of a harder material, such as leather, cardboard or wood.

The entire insole may also consist of a single piece, in this case a sturdy material as is suitable for a toe area. In this case the seam N2' is designed as a glued seam.

Figure 4:
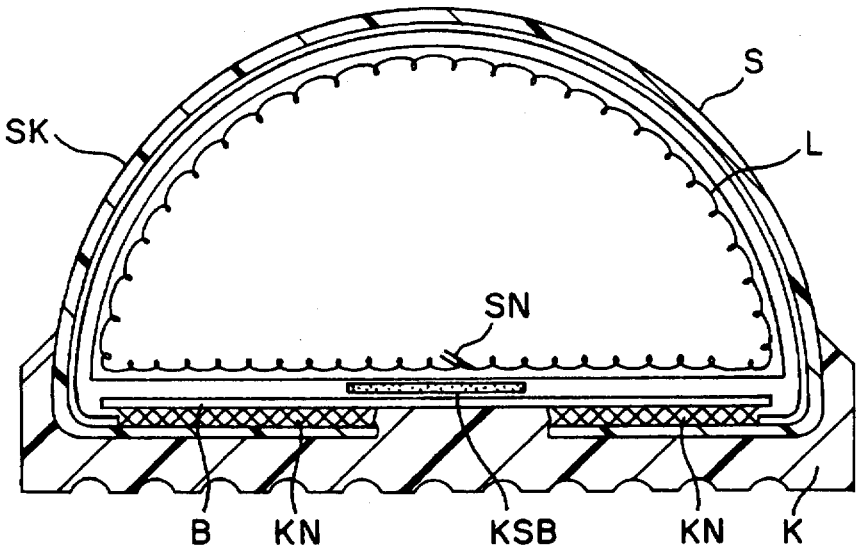
FIG. 4 is a cross-sectional drawing of the toe area of footwear designed according to the invention.

FIG. 4 shows a cross-sectional view of the toe area of the footwear shown in FIG. 3. From the drawing it is seen that the protective cap SK is located between the shaft S and the partial sock consisting of the laminate. The bootie may consist of two laminate pieces connected by a sock seam SN.

It is advantageous to seal this sock seam SN by applying an adhesively bonded waterproof seam sealing tape KSB to the underside of the bootie against the ingress of water.

The bootie may also be made from a piece which is adapted to the contours of the toe area of the shoe and which is connected to the laminate lining in the toe area of the shaft by means of a seam. In this case, too, the seam is sealed against the ingress of water by an adhesive seam tape.

Depending on whether the footwear of the invention is constructed with a one-piece insole or with two separate insole pieces, various manufacturing processes can be used.

In both cases at first a tape-shaped connection material V, preferably in the form of a net consisting of monofilic fibers, is connected to the edge of the cut-to-size lag facing the outsole in the area of the middle foot and heel. Then a laminate piece is cut to size such that its shape matches the shaft piece. Its toe area is then closed in the form of a bootie on the outsole side by means of a laminate piece. This laminate piece may be formed either by two laminate pieces connected to the cut-to-size laminate piece which are connected with each other by a waterproof seam to form a laminate bootie, as shown in the embodiment of FIG. 3, or the laminate piece may be formed by a laminate piece which corresponds to the toe contours of the shoe and which is connected to the cut-to-size laminate piece by a waterproof seam.

After such a laminate bootie has been produced, the next processing step depends on whether a one-piece or two-piece insole is used.

If a two-piece insole is used, the free edge of the connection material and the edge of the outsole facing the middle foot area are connected to the first insole part B1 then the second insole piece B2 is connected to the outsole side of the bootie.

If a one-piece insole is used, the toe area of the insole is connected to the outsole-side of the bootie on the one hand and the free edge of the connecting material and the edge of the outsole side of the bootie which faces the middle foot area on the other hand are connected to the insole.

In both cases, i.e., no matter whether a one-piece or two-piece insole is used, the protective cap SK is mounted between the shaft S and the laminate L in the toe area in such a way that the underside of the protective cap facing the outsole K goes under the circumferential edge of the insole on its outsole side. Subsequently the outsole side end of the shaft S is connected to the outsole side of the second insole piece B2 or of the one-piece insole in the toe area. Finally the outsole is connected by injection molding.

Materials suitable for the waterproof, water vapor permeable functional layer of the laminate comprise microporous expanded polytetrafluoroethylene (PTFE) as described in U.S. Pat. Nos. 3,953,566 and 4,187,390; expanded PTFE provided with hydrophilic impregnating agents and/or layers as described in U.S. Pat. No. 4,194,041; breathable polyurethane layers or elastomers, such as copolyetherester and laminates thereof, as described in U.S. Pat. Nos. 4,725,481 and 4,493,870.

I claim:

1. Footwear with:

(a) a shaft;

(b) a laminate lining the shaft, having a waterproof and water vapor permeable functional layer;

(c) an insole connected to the laminate;

(d) a waterproof plastic outsole injection molded to the lower part of the shaft;

(e) wherein the shaft material itself ends at a certain distance from the outsole side end of the laminate in the middle foot area and heel area; and (f) wherein the outsole side end of the shaft material itself is connected to the insole and the outsole-side end of the laminate in a middle foot area and heel area of the footwear through a connection material formed by a porous connection material which can be penetrated by the outsole material when the latter is in the liquid state during the injection molding process;

characterized by (g) a rigid protective cap which is arranged in a toe area of the footwear between the shaft and the laminate and whose underside facing the outsole goes under the insole over a predetermined width;

(h) a bootie consisting of a laminate which is arranged in the toe area on the side of the insole facing the foot where it lines the inside of the footwear; and (I) wherein the shaft material is connected to the insole circumference in the toe area on the side of the insole facing the outsole by a glued connection.

2. Footwear of claim 1, characterized in that the bootie comprises two laminate pieces which project into the toe area from the laminate which lines the shaft and which are connected with each other by a seam which is sealed against the ingress of water by an adhesively bonded seam sealing tape.

3. Footwear of claim 1, characterized in that the bootie has a laminate piece which corresponds to the contours of the toe area of the footwear and which is connected to the laminate which lines the toe area of the shaft by a seam which is sealed against the ingress of water by an adhesively bonded seam sealing tape.

4. Footwear of one of claims 1, 2 or 3, characterized in that the porous connection material is formed by a net band, preferably consisting of monofilic fibers.

* * * * *